United States Patent [19]

Wacula et al.

[11] 4,237,787

[45] Dec. 9, 1980

[54] INCENDIARY PROJECTILE

[75] Inventors: Klaus P. Wacula, Nuremberg; Karl Emmerling, Neumarkt, both of Fed. Rep. of Germany

[73] Assignee: Diehl GmbH & Co., Nuremberg, Fed. Rep. of Germany

[21] Appl. No.: 953,434

[22] Filed: Oct. 23, 1978

[30] Foreign Application Priority Data

Nov. 26, 1977 [DE] Fed. Rep. of Germany ..... 2752946

[51] Int. Cl.[3] ..... F42B 11/14; F42B 13/04

[52] U.S. Cl. ..... 102/52; 102/66; 149/44

[58] Field of Search ..... 102/52, 66; 149/43, 149/44

[56] References Cited

U.S. PATENT DOCUMENTS

| | | | |
|---|---|---|---|
| 2,115,047 | 4/1938 | Stevenson | 149/44 |
| 2,131,041 | 9/1938 | Hale | 149/44 X |
| 3,411,964 | 11/1968 | Douda | 149/43 X |
| 3,677,842 | 7/1972 | Doris, Jr. | 149/44 X |

FOREIGN PATENT DOCUMENTS

| | | | |
|---|---|---|---|
| 2552950 | 6/1977 | Fed. Rep. of Germany | 102/52 |
| 308219 | 9/1955 | Switzerland | 149/43 |
| 1205378 | 9/1970 | United Kingdom | 149/44 |
| 267407 | 7/1970 | U.S.S.R. | 149/43 |

*Primary Examiner*—Leland A. Sebastian

*Attorney, Agent, or Firm*—Scully, Scott, Murphy & Presser

[57] ABSTRACT

An incendiary projectile, particularly an armor-piercing projectile, including an incendiary composition constituted of a metal powder admixture as a reducing agent and an inorganic oxidizing agent; and a binding agent for converting these components into a solid form. The oxidizing agent is a nitrate or peroxide of the elements selected from the group consisting of potassium, strontium or barium, the oxidizing and reduction agents being present in about equal parts in the incendiary composition. Binding agents are included in the admixture in a predetermined amount so as to formulate the admixture into a hard-grained agglomerate and to produce a resultant increased impact sensitivity of the incendiary composition.

6 Claims, 1 Drawing Figure

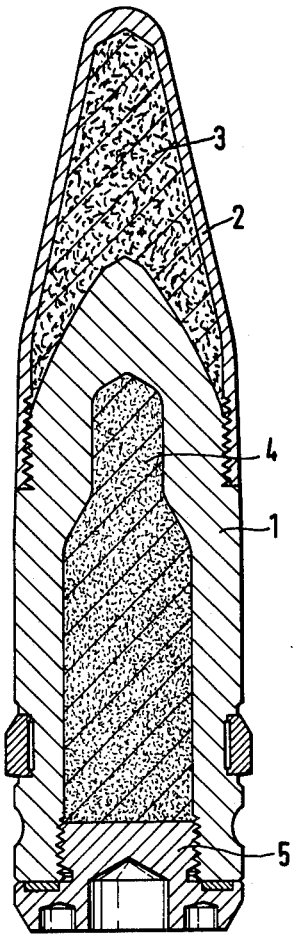
3
2
4
1
5

INCENDIARY PROJECTILE

BACKGROUND OF THE INVENTION

1. Field of the Invention

The present invention relates to an incendiary projectile, particularly an armor-piercing incendiary projectile, including an incendiary composition which is constituted of a metal powder or a metal power admixture as a reducing agent and of an inorganic oxidizing agent, wherein these compositions are converted into a solid form through the intermediary of a binding agent.

2. Discussion of the Prior Art

An incendiary projectile is presently known from German Petty Patent No. 74 39 412 wherein there is employed that type of incendiary composition. The foregoing pertains to a large-calibered projectile which is to be utilized for the establishment of area or surface conflagrations. In accordance with the particular task set, the incendiary composition should be constituted in its composition so as to afford the longest possible burning period. For the igniting thereof there is required a special ignition charge so that, in conjunction with the sought-after characteristic burning relationship, this composition will impart a relatively high reaction inertia to the incendiary composition. As a consequence, its use is restricted to large-calibered incendiary projectiles, as well as to incendiary bombs.

It has also been heretofore proposed that for the purpose of the utilization of such incendiary compositions of energy carrying agents and oxidants, particularly those which are based on thermite, that there also be provided an additive in armor-piercing projectiles which will increase the intensity of the reaction, for instance cerium-iron, and to include especially rapidly and intensively reacting ignition charges. However, the employment of that type of incendiary composition generates problems based on a number of reasons. Thus, on the other hand, the above-mentioned additives are relatively expensive and, on the other hand, the required ignition charges of the above-mentioned type necessitate the application of additional precautionary measures during processing which, in the final analysis, is also a cost-increasing factor.

In contrast therewith, the more inexpensively produced incendiary charges which are based on phosphorus, for instance a known incendiary composition which is employed in incendiary projectiles contains 75% red phosphorus and 25% magnesium, thus possess the advantage that they do not require a separate ignition charge, nevertheless they evidence significant disadvantages with regard to their safety during processing and handling. Besides the danger of a development of noxious fumes and the possible spontaneous combustion when contacted by air, for incendiary projectiles having high initial or discharge velocities there exists the danger of a premature combustion during flight. Further, for the development of their effectiveness, it is necessary to have the presence of atmospheric oxygen.

SUMMARY OF THE INVENTION

Accordingly, it is an object of the present invention to provide an incendiary composition for incendiary projectiles which requires neither a separate ignition charge nor atmospheric oxygen for ignition, which additionally is safe during processing and handling and, concurrently, is as inexpensive as possible.

The foregoing object is attained through the provision of an incendiary projectile, particularly an armor-piercing incendiary projectile, including an incendiary composition which contains nitrates or peroxides of the elements selected from the group containing potassium, strontium or barium as an oxidizing agent, wherein oxidizing and reducing agents are contained in the incendiary composition in approximately equal parts, and wherein binding agents are added to this admixture in an amount of 1 to 5% by weight so as to formulate a hard-grained agglomerate and, as a result, lead to an enhanced impact sensitivity of the incendiary composition. Through the addition of a binding agent leading to a hard-grained agglomerate to the known incendiary admixtures for incendiary projectiles, which consist of reducing and oxidizing agents, the friction within the incendiary composition is increased considerably and benefited thereby the conversion from kinetic energy into thermal energy at impact, so as to extensively increase the impact sensitivity of these incendiary admixtures. Thereby, the incendiary composition of the inventive incendiary projectile will dependably spontaneously ignite at impact against a target, without necessitating a separate ignition charge. Simultaneously, the binding agent prevents a decomposition of the incendiary composition which would influence the burning reaction.

Due to its relatively high insensitivity to temperature changes both before and after processing, this incendiary composition may, on the one hand, be processed without necessitating complex precautionary measures and, on the other hand, when employed in incendiary projectiles with high discharge velocities, will not produce the danger of spontaneous combustion during flight. The incendiary composition of the inventive incendiary projectile is hereby not only temperature-stable and safe in handling, but also considerably less expensive than the known self-igniting incendiary compositions which are based on phosphorus.

Inasmuch as the incendiary composition in the incendiary projectile pursuant to the invention is present as a hard-grained agglomerate, at impact against a target by an incendiary projectile which is filled with this incendiary composition, there is achieved that a rapid burning effect is attained not only in the area of the impact location. The burning effect extends much further beyond the region of the armor, insofar as it relates to a projectile with a piercing core, due to the solid granulation and the therewith connected inertia, as well as the relatively lengthy burning period in contrast with an incendiary mixture which is compressed into a powder form. The incendiary composition is hereby pulled along by the shock wave of the piercing core penetrating through the target wall and sprayed out drop-like in an incandescent condition. The range of the incendiary effect and the effective duration of the effect, as well as the impact sensitivity, can hereby be varied, wherein it is to be noted that the larger particles increase the range but concurrently reduced the intensity of the reaction.

A particularly suitable binding agent is represented by chlorinated rubber, a material which is known as a chloridization factor for intensifying the color of flare compositions. Also suitable as binding agents are silicon resins.

Thusly, the utilization of chlorinated rubber as a binding agent in a granulated admixture of a metallic reducing agent and an inorganic oxidizing agent has become known from British Pat. No. 1,205,378, in essence, the admixture is to be employed for the demolition of building structures, however, herein the activation of this known admixture is carried out by means of an electrical detonating capsule. Consequently, it is to be considered as surprising, and not at all rendered obvious in any manner by the mentioned British specification, when such an admixture is employed as an incendiary composition in an incendiary projectile, this composition will spontaneously ignite without an additional igniting agent at impact against a target and will become effective in the abovedescribed manner.

The preferred embodiment of the inventive incendiary projectile contemplates an admixture as the incendiary composition of about 40 to 60% by weight of barium nitrate, about 1.5% by weight of the binding agent (chlorinated rubber or silicon resin), and as the remainder being an admixture of aluminum and magnesium powder in a ratio of 1:1.

This composition is particularly adapted for use in armor-piercing incendiary projectiles, wherein the incendiary effect is essentially dependent upon the precise correlation between the penetration of the hard core through the armoring of the target objective and the ignition of the incendiary composition. Only when this correlation becomes optimum is there obtained a burning effect at the impact location, as well as also in the area rearwardly of the armoring.

However, the incendiary composition is, in the same manner, also applicable for use in incendiary projectiles of other types, for instance, in explosive incendiary projectiles in which the incendiary composition is sprayed about in the surroundings of the impact location upon the detonation of an explosive charge. Hereby, the binding agent prevents too fine a dispersion and, thereby, a too rapid burning down of the admixture. However, use thereof is also possible in large-calibered incendiary projectiles.

BRIEF DESCRIPTION OF THE DRAWING

The invention is now described in detail in conjunction with an exemplary embodiment thereof, wherein the single FIGURE of the drawing illustrates a longitudinal section through an armor-piercing incendiary projectile with an applied tip or nose cone and two incendiary compositions.

DETAILED DESCRIPTION

Pursuant to the drawing, mounted on the forward end of a penetrating core 1 constructed as a hollow projectile is a ballistic tip or nose cone 2, for example, by being threaded or flanged thereon. Pressed into this nose cone is an incendiary composition 3. The incendiary composition in this exemplary embodiment consists of 50.5% by weight of barium nitrate, up to 48% by weight of an admixture of aluminum and magnesium powders in a ratio of 1:1, as well as 1.5% by weight of chlorinated rubber (for example, "Pergut-S 10") as a binding agent, and is present in the form of a hard-grained agglomerate.

Located within the hollow projectile 1 is a further pyrotechnic composition 4 which, in this embodiment, is also an incendiary composition. However, it is also possible that this second incendiary charge may be entirely or partially replaced by an explosive charge. The hollow projectile 1 is rearwardly closed off by a projectile base 5.

At the impact of such a projectile against an armored target, there will initially ignite the incendiary charge 3 located beneath the nose cone 2 as a result of the friction heat generated by the hard-grained agglomerate. At the penetration by the hard core 1 through the armoring, and the therewith associated rupturing of the projectile, there is also released the second incendiary charge 4 which will ignite at the previous burning composition 3 and, as well as the latter, will be conducted in the shock wave of the hard core far into the area behind the armoring. Since a major portion of the incendiary composition will not yet be ignited at impact, the incandescent particles still evidence a high incendiary capability and can ignite fuel canisters, ammunition containers and the like.

We claim:

1. In an incendiary projectile, particularly an armor-piercing projectile, including an incendiary composition constituted of a metal powder admixture as a reducing agent and an inorganic oxidizing agent; and a binding agent for converting these components into a solid form, the improvement comprising: the incendiary composition providing for increased sensitivity to impact to spontaneously ignite upon impact against a target without requiring a separate ignition charge, said oxidizing agent being nitrate or peroxide of the elements selected from the group consisting of potassium, strontium or barium, said oxidizing and reduction agents being present in about equal parts in said incendiary composition; and binding agents being included in said admixture in an amount of 1 to 5% by weight so as to formulate said admixture into a hard-grained agglomerate and with a resultant increased impact sensitivity of said incendiary composition.

2. Incendiary projectile as claimed in claim 1, said binding agent comprising 1.5% by weight of said admixture.

3. Incendiary projectile as claimed in claim 1 or 2, said binding agent being constituted of chlorinated rubber.

4. Incendiary projectile as claimed in claim 1 or 2, said binding agent being constituted of a silicon resin.

5. Incendiary projectile as claimed in claim 1, said incendiary composition including about 40 to 60% by weight of barium nitrate; about 1.5% by weight of said binding agent; and the remainder containing an admixture of aluminum and magnesium powder in a ratio of 1:1.

6. Incendiary projectile as claimed in claim 5, including about 50% by weight of barium nitrate.

* * * * *

UNITED STATES PATENT AND TRADEMARK OFFICE

CERTIFICATE OF CORRECTION

PATENT NO. : 4,237,787

DATED : December 9, 1980

INVENTOR(S) : Klaus P. Wacula, et al.

It is certified that error appears in the above-identified patent and that said Letters Patent are hereby corrected as shown below:

Column 1, line 9, "power" should read -- powder --.

Column 1, line 40, "other" should read as -- one --

Column 2, line 10, after "1 to 5%" the words -- preferably 1.5% by weight -- were omitted.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*